US005260158A

United States Patent [19]

Yamaji et al.

[11] Patent Number: 5,260,158

[45] Date of Patent: Nov. 9, 1993

[54] PHOTOCONDUCTIVE TONER COMPRISING A SENSITIZER DYE

[75] Inventors: Hiroyuki Yamaji, Itami; Akiyoshi Urano, Takarazuka; Yumiko Sano, Ibaraki, all of Japan

[73] Assignee: Mita Industrial Co., Ltd., Osaka, Japan

[21] Appl. No.: 717,152

[22] Filed: Jun. 18, 1991

[30] Foreign Application Priority Data

Jun. 19, 1990 [JP] Japan ..... 2-160776

[51] Int. Cl.[5] ..... G03G 9/09

[52] U.S. Cl. ..... 430/106; 430/109; 430/901

[58] Field of Search ..... 430/93, 106, 901, 109

[56] References Cited

U.S. PATENT DOCUMENTS

| | | | |
|---|---|---|---|
| 3,649,299 | 3/1972 | Chapman et al. | 96/3 |
| 3,653,897 | 4/1972 | Chapman | 96/3 |
| 4,301,227 | 11/1981 | Hotta et al. | 430/106.6 |
| 4,539,284 | 9/1985 | Barbetta et al. | 430/110 |
| 4,587,195 | 5/1986 | Ishikawa et al. | 430/139 |
| 4,921,768 | 5/1990 | Kunugi et al. | 430/45 |
| 5,053,821 | 10/1991 | Kunugi et al. | 355/245 |

FOREIGN PATENT DOCUMENTS

| | | |
|---|---|---|
| 2357584 | 5/1974 | Fed. Rep. of Germany . |
| 237364 | 2/1990 | Japan . |
| 02-135367 | 5/1990 | Japan . |
| 3-15076 | 1/1991 | Japan . |
| 3-160461 | 7/1991 | Japan . |
| 3-160462 | 7/1991 | Japan . |

OTHER PUBLICATIONS

Patent Abstracts of Japan, vol. 14, No. 191 (P-1038) (4134), Apr. 18, 1990 of JP-A-2 37364, Feb. 7, 1990.

Patent Abstracts of Japan, vol. 07, No. 206 (P-222) (1351), Sep. 10, 1983 of JP-A-58 102247, Jun. 17, 1983.

*Primary Examiner*—Marion E. McCamish

*Assistant Examiner*—Rosemary Ashton

*Attorney, Agent, or Firm*—Armstrong, Westerman, Hattori, McLeland & Naughton

[57] ABSTRACT

A photoconductive toner of the present invention contains a resin binder, zinc oxide, and a dye for sensitization of the zinc oxide, the sensitizer dye being represented by the following formula (1):

(1)

wherein (Abstract continued on next page.)

ABSTRACT

-continued

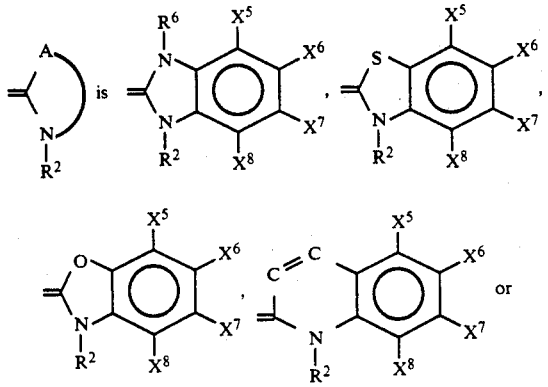

-continued

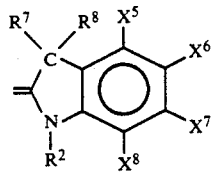

wherein, $X^1$ to $X^8$ represent hydrogen or methoxy groups with a proviso that at least one of $X^1$ to $X^8$ represents a methoxy group, $R^1$ and $R^2$ are independently alkyl groups or derivatives thereof, and n is an integer. A photoconductive toner of the present invention satisfies requirements for both sensitivity and coloration, and, moreover, possesses high photosensitivity in the laser wavelength region as compared with conventional toners.

6 Claims, 2 Drawing Sheets

PHOTOCONDUCTIVE TONER COMPRISING A SENSITIZER DYE

BACKGROUND OF THE INVENTION

1. Field of the Invention

The present invention relates to photoconductive toners, more specifically, to photoconductive toners which are sensitive to red light, green light or blue light, and to photoconductive toners possessing photosensitivity in the laser wavelength region.

2. Description of the Art

Recently, considerable attention has been directed toward methods for the formation of colored images with just a single exposure by using mixed toners consisting of three varieties of photoconductive toners which have been colored cyan, magenta and yellow, respectively (i.e., a cyan toner, a magenta toner, and a yellow toner).

Each of these colored toners possesses sensitivity to light of the complementary color, i.e., the cyan toner is sensitive to red light, the magenta toner is sensitive to green light, and the yellow toner is sensitive to blue light. The respective photoconductive toners acquire photoconductivity by exposure to the corresponding colors of light. Therefore, for example, if a mixed toner is compounded by mixing a yellow toner which manifests photosensitivity with respect to light in the vicinity of 450 nm, a magenta toner which manifests photosensitivity with respect to light in the vicinity of 550 nm, and a cyan toner which manifests photosensitivity with respect to light in the vicinity of 650 nm, then, if this mixed toner is used in a one-shot color system, a colored image can be formed by a single exposure.

However, in order to prevent an undesirable mixture of colors, the photosensitive wavelength regions of the three colored photoconductive toners employed in such a one-shot color system must be separated, thus, three varieties of photoconductive toners with photosensitivity in the vicinity of 450 nm, 550 nm, and 650 nm, respectively, as indicated above, are regarded as necessary for this purpose.

Such photoconductive toners ordinarily contain a resin binder, zinc oxide, and a dye sensitizer; the present applicant has previously filed on application relating to a photoconductive toner employing cyanine dyes as the dye sensitizers (i.e., Japanese Patent Application Nos. 1-150935, 1-300365, and 1-300366). However, when this type of cyanine dye was used as the dye sensitizer, the photosensitivity of the toner dropped in some cases where a relatively large quantity of the dye was added. Therefore, a photoconductive toner satisfying both the requirements of displaying the necessary hue and possessing sufficient sensitivity was difficult to obtain, and consequently vivid images could not be formed with this toner.

In particular, cyanine dyes have the disadvantage in that the sensitivity of such dyes in the vicinity of 450 nm is markedly low as compared with that of dye sensitizers with sensitivity in other wavelength regions. Moreover, if a photoconductive toner is prepared using dye sensitizers other than the aforesaid cyanine dyes, then another disadvantage arises in that, for example, if fluorescein is used as the sensitizer dye for blue light, then, although the sensitizing effect upon zinc oxide is comparatively great, the sensitive wavelength is shifted toward the long wavelength side, resulting in a poor hue of the toner.

On the other hand, laser printers have come into wide use in recent years, so there now exists a need for photoconductive toners with photosensitivity in the near infrared to infrared region.

SUMMARY OF THE INVENTION

The photoconductive toner of this invention, which overcomes the above-discussed and numerous other disadvantages and deficiencies of the prior art, comprises a resin binder, zinc oxide and a sensitizer dye for sensitization of zinc oxide, the dye being represented by the following general formula (1):

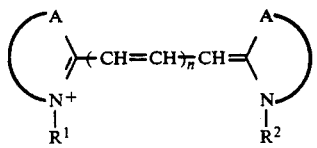

(1)

wherein

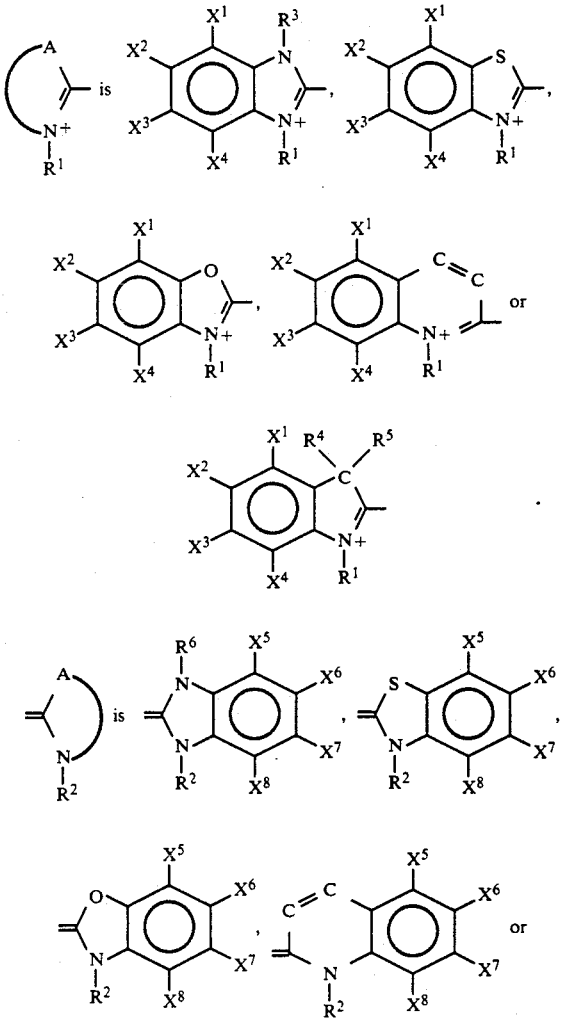

-continued

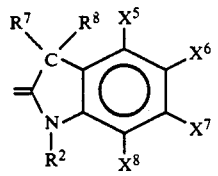

wherein $X^1$ to $X^8$ represent hydrogen or methoxy groups with a proviso that at least one of $X^1$ to $X^8$ represents a methoxy group, $R^1$ and $R^2$ are independently alkyl groups or derivatives thereof, $R^3$ to $R^8$ are independently hydrogen or alkyl groups, and n is an integer.

In a preferred embodiment, the sensitizer dye is represented by formula (1), where two of $X^1$ to $X^8$ are methoxy groups.

In a preferred embodiment, the sensitizer dye is represented by formula (1), where at least three of $X^1$ to $X^8$ are methoxy groups.

In a preferred embodiment, the sensitizer dye is represented by formula (1), where at least one of $X^1$ to $X^4$ is a methoxy group, and at least one of $X^5$ to $X^8$ is a methoxy group.

In a preferred embodiment, the integer n is in the range of 0 to 4.

In a preferred embodiment, the zinc oxide is contained in the proportion of 3 to 600 weight percent relative to the resin binder.

In a preferred embodiment, the zinc oxide is contained in the proportion of 5 to 500 weight percent relative to the resin binder.

In a preferred embodiment, the sensitizer dye is contained in the proportion of 0.05 to 10 weight percent relative to the zinc oxide.

In a preferred embodiment, the sensitizer dye is contained in the proportion of 0.1 to 3 weight percent relative to the zinc oxide.

In a preferred embodiment, the sensitizer dye comprises a first dye, a second dye, and a third dye, the first dye has an integer n of 0, the second dye has an integer n of 1, and the third dye has an integer n of 3.

In a preferred embodiment, the photoconductive toners possess photosensitivity in the laser wavelength region, and the sensitizer dye has an integer n of at least 3.

Thus, the invention described herein makes possible the objectives of (1) providing photoconductive toners such that increased addition of dye does not lower the sensitizing effect upon the zinc oxide, so that both sensitivity and coloration requirements can be satisfied, (2) providing photoconductive toners permitting the formation of clear vivid images satisfying requirements for both distinct coloration and adequate sensitivity, (3) providing photoconductive toners permitting the improvement of coloring efficacy by virtue of the fact that the quantity of added dye can be increased without diminishing the sensitivity of the zinc oxide, (4) providing photoconductive toners which can be prepared in three varieties, i.e., yellow, magenta, and cyan, possessing photosensitivity in the wavelength regions in the vicinity of 450 nm, 550 nm, and 650 nm, respectively, and all manifesting comparatively high effectiveness in sensitizing zinc oxide, (5) providing photoconductive toners to which photosensitivity in various wavelength regions, such as the near infrared to infrared region, can be imparted by appropriately varying the number of methine groups or the heterocyclic structure of the dye sensitizer, (6) providing photoconductive toners permitting the formation of clear vivid images in one-shot color systems employing photoconductive toners, (7) providing photoconductive toners possessing higher photosensitivity in the near infrared to infrared laser wavelength region as compared with previously existing photoconductive toners, and (8) providing photoconductive toners highly suitable for use in laser printers by virtue of adequate photosensitivity in the near infrared to infrared region.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
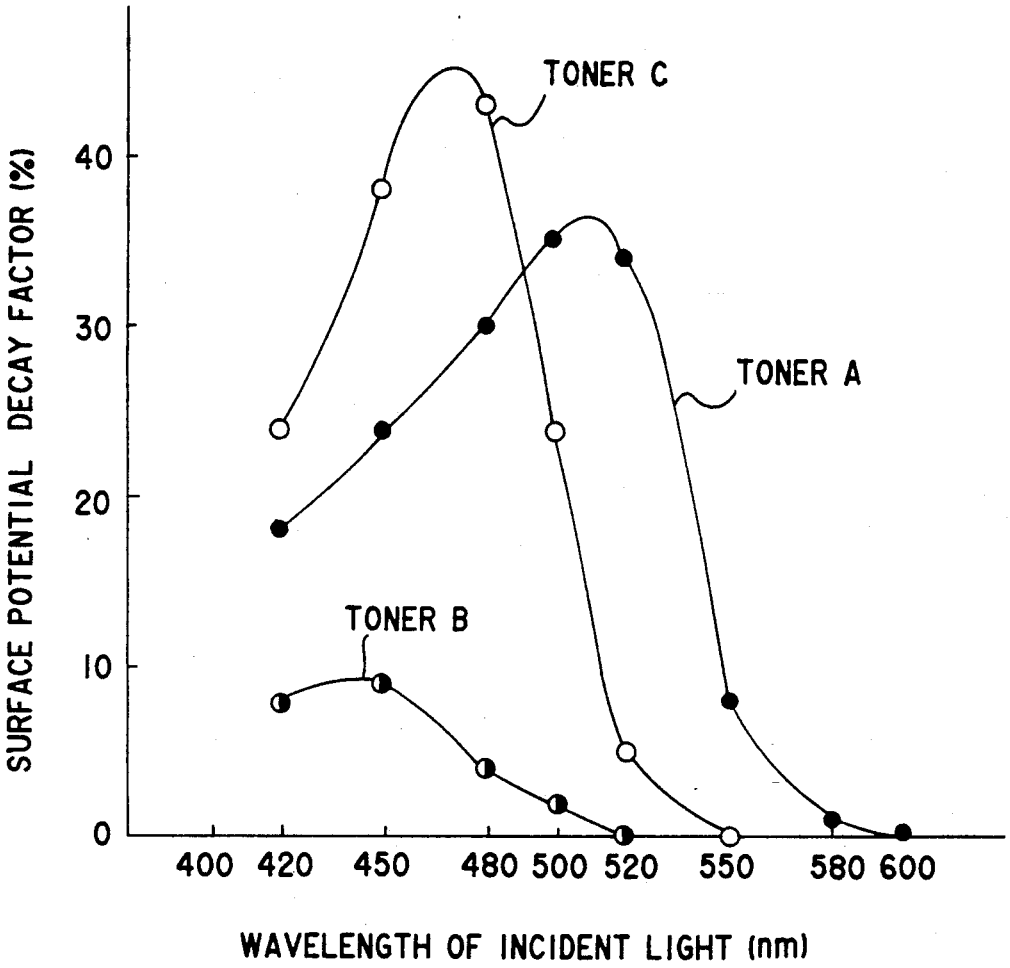
FIG. 1 is a graph showing the relationship between the wavelength of incident light and the surface potential decay factor for three varieties of toners.

The photoconductive toners of the present invention contain an electrically insulating resin binder, zinc oxide as a photoconductive material, and the aforesaid cyanine dyes as dye sensitizers. Furthermore, the photoconductive toners of the present invention can be prepared by pulverization or atomization in accordance with conventional methods. For example, if atomization is used, the resin solution obtained by dispersing or dissolving the aforesaid ingredients in an appropriate solvent is sprayed into the form of fine particles, thereby obtaining the desired photoconductive toner.

Various well-known types of electrically insulating resins can be used as the aforesaid resin binder; plastics appropriate for this purpose include, for example, various types of polymers such as styrene type polymers, styrene-butadiene copolymers, styreneacrylonitrile copolymers, styrene-maleic acid copolymers, acrylic polymers, styrene-acrylic copolymers, ethylene-vinyl acetate copolymers, polyvinyl chloride, vinyl chloride-vinyl acetate copolymers, polyesters, alkyd resins, polyamides, polyurethanes, acrylic-modified urethane resins, epoxy resins, polycarbonates, polyarylates, polysulphones, diarylphthalate resins, silicone resins, ketone resins, polyvinyl butyral resins, polyether resins, phenolic resins. Moreover, photoconductive resins such as polyvinylcarbazole can also be used either alone or in combination with electrically insulating resins.

The dye sensitizer represented by formula (1) are used for the purpose of sensitizing the zinc oxide which is employed as the photoconductive material. These dye sensitizers are cyanine dyes with methoxy groups as substituents on the benzene rings of the heterocyclic moieties of the said dyes. The sites of linkage of these methoxy groups are not restricted. In particular, methoxy groups should preferably be linked to each benzene ring, or still more preferably methoxy groups linked to each benzene ring and two or more in number should be present. The number of methoxy groups should be 1 to 4, more desirably 2 or 3. Furthermore, in formula (1), the groups $R^1$ and $R^2$ are unmodified alkyl groups or derivatives of alkyl groups. If $R^1$ is an alkyl group, for example, a methyl, ethyl, propyl, butyl, pentyl, hexyl, or heptyl group, etc., the assocciated counter ion can be $I^-$, $ClO^{4-}$, $Br^-$, $Cl^-$, etc.

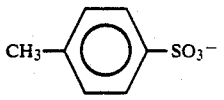

Among the alkyl group derivatives applicable in the role of the group $R^1$ are, for example, $(CH_2)_2SO_3^-$, $(CH_2)_3SO_3^{-1}$, $(CH_2)_2COO^-$, $(CH_2)_3COO^-$, etc. The groups $R^1$ and $R^2$ can be either identical or distinct.

Furthermore, the integer n in the foregoing formula should preferably be in the range of 0 to 4, or more preferably 0 to 3. If n is 0 (i.e., if one methine group is present in the central chain), then ordinarily a yellow photoconductive toner with photosensitivity in the vicinity of 450 nm is obtained. If n is 1 (i.e., if two methine groups are present in the central chain), then a magenta photoconductive toner with photosensitivity in the vicinity of 550 nm is obtained, while if n is 2 (i.e., three methine groups are present in the central chain), then a cyan photoconductive toner with photosensitivity in the vicinity of 650 nm is obtained. If n is 3 or more (i.e., if four or more methine groups are present in the central chain), then a photoconductive toner with photosensitivity in the near infrared to infrared region is obtained.

Specific examples of such dye sensitizers are, for example, the cyanine dyes (A), (B), (C), and (D) with the structures shown by the following formulae [A], [B], [C], and [D], respectively. The cyanine dyes shown here are merely illustrative examples and do not by any means limit the scope of the cyanine dyes subsumed by the present invention. For example, cyanine dyes with a variety of structures applicable for the present purpose can be obtained by appropriately varying A, $R^1$, $R^2$, or the number n in the formula (1).

[A]

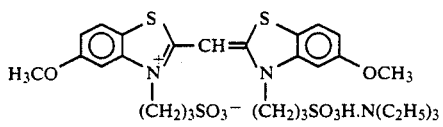

[B]

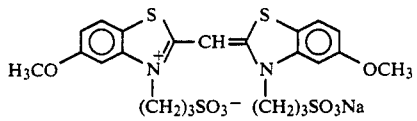

[C]

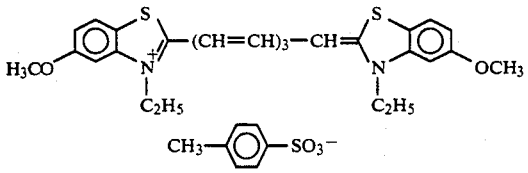

[D]

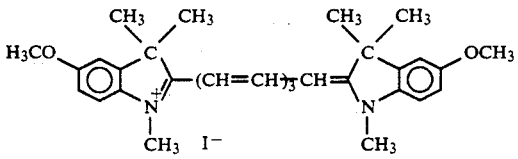

The zinc oxide employed as the photoconductive material in the present invention is of course universally known, and ordinary commercially marketed zinc oxide is suitable for the present purpose. Zinc oxide should preferably be used in the proportion of 3 to 600 weight percent, or more preferably 5 to 500 weight percent, relative to the resin binder. If the quantity of zinc oxide exceeds the stated upper limit, then the charge retention characteristics of the toner so obtained tend to deteriorate; on the other hand, if the quantity of zinc oxide is less than the stated lower limit, then the densities of the images formed by the toner so obtained tend to drop, moreover, the toner sensitivity also tends to diminish.

The proportion of the aforesaid dye sensitizer in the toner is preferably in the range of 0.05 to 10 weight percent, or more preferably 0.1 to 3 weight percent. If the proportion of dye sensitizer exceeds the stated upper limit, then the electrification characteristics of the photoconductive toner deteriorate, while the photosensitivity also tends to diminish to some extent; on the other hand, if the proportion of dye sensitizer is less than the stated lower limit, then the sensitizing effect upon the zinc oxide is slight.

In addition to the ingredients stated above, the photoconductive toner of the present invention may also contain, if required, various auxiliaries such as known dyes or pigments as colorants; waxes as offset prevention agents; and agents for imparting pressure sensitive adhesion properties, compounded into the toner in accordance with well known prescriptions.

Furthermore, the meaning of the term "high photosensitivity" in the context of the present invention is as follows. The initial surface potential (Vd) and post-exposure surface potential (Vl) of the charged toner are measured, and the photosensitivity is said to be high if the surface potential decay factor (Vd-Vl)/Vd is comparatively large. Alternatively, an electrode is vapor-deposited onto a pressed toner layer, a predetermined voltage is applied, the electrical current flowing before and after exposure (Id: dark current value and Il: photoelectric current value, respectively) are measured, and the photosensitivity is said to be high if Il is comparatively large, or if the gain Il/Il is comparatively large.

EXAMPLES

In the following, the present invention will be explained in more specific detail with reference to concrete examples and comparative examples.

COMPARATIVE EXAMPLE 1

Zinc oxide Grade #2 (brand name, Hakusui Chemical Company): 100 weight parts

Fluorescein: 0.1 weight parts Styrene-acrylic resin PA-525 (brand name, Mitsui Toatsu Chemical Company): 33 weight parts Toluene: 1000 weight parts After thoroughly dispersing and mixing the aforesaid ingredients, a particulate yellow photoconductive toner A with mean grain size of 10 μm was obtained by spray drying.

This toner A was mixed with a ferrite carrier and subjected to frictional electrification. Then, the toner was introduced into a magnetic brush developing device for electrophotographic copying machines, and using this developing device, the photoconductive toner was uniformly deposited upon an aluminum substrate. This toner layer was irradiated for 0.5 sec. with monochromatic light of wavelength in the range of 400 to 850 nm, produced by a monochromator; the surface potentials before and 1.0 sec. after exposure were measured, and the surface potential decay factor (maximum surface potential decay factor) was determined by a computer connected with a digital oscilloscope. The results so obtained are shown in Table 1 and FIG. 1.

COMPARATIVE EXAMPLE 2

A particulate toner B with mean grain size of 10 μm was obtained by the same procedure as in Comparative Example 1, except that the cyanine dye NK-88 (brand name, Nihon Photosensitive Dye Laboratories, Ltd.), with the structure shown in formula [E] below, was used in place of fluorescein in the proportion of 0.1 weight percent relative to zinc oxide.

The surface potential decay factor was measured with respect to the resulting toner B in the same manner as in Comparative Example 1. The results so obtained are indicated in Table 1 and FIG. 1.

[E]

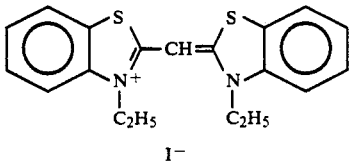

EXAMPLE 1

A particulate toner C with a mean grain size of 10 μm was obtained by the same procedure as in Comparative Example 1, except that the cyanine dye represented by the above formula [A] was used in place of fluorescein in the proportion of 0.1 weight percent relative to zinc oxide.

The surface potential decay factor was measured with respect to the resulting toner C in the same manner as in Comparative Example 1. The results so obtained are indicated in Table 1 and FIG. 1.

TABLE 1

| Surface potential decay factor (%) at each wavelength of toner A, toner B, and toner C. | | | | | | | | |
|---|---|---|---|---|---|---|---|---|
| Wavelength (nm) | 420 | 450 | 480 | 500 | 520 | 550 | 580 | 600 |
| Toner A | 18 | 24 | 30 | 35 | 34 | 8 | 1 | 0 |
| Toner B | 8 | 9 | 4 | 2 | 0 | 0 | 0 | 0 |
| Toner C | 24 | 38 | 43 | 43 | 5 | 0 | 0 | 0 |

As is apparent from Table 1 and FIG. 1, the photosensitivity of the toner C, prepared with a cyanine dye possessing a structure of the type characterized by the present invention, displays a peak in the 450 nm wavelength region and a large drop for wavelengths of 500 nm or more, thus demonstrating that the present yellow toner would not be prone to cause undesirable intermingling of colors in the so-called one-shot color systems.

COMPARATIVE EXAMPLE 3

Various toners were obtained by the same procedure as in Comparative Example 2, except that the cyanine dye employed in Comparative Example 2 was used in various proportions ranging from 0.1 to 1.0 weight percent. The surface potential decay factor at 450 nm was measured with respect to these various toners. The results are shown in Table 2 and FIG. 2.

EXAMPLE 2

Various toners were obtained by the same procedure as in Example 1, except hat the cyanine dye employed in Example 1 was used in various proportions ranging from 0.1 to 1.0 weight percent. The surface potential decay factor at 450 nm was measured with respect to the these various toners. The results are shown in FIG. 2.

TABLE 2

| Surface potential decay factor (%) as the quantity of added cyanine dye is increased. | | | | | | | |
|---|---|---|---|---|---|---|---|
| Added Amount (weight %) | 0.05 | 0.1 | 0.2 | 0.3 | 0.5 | 0.7 | 1.0 |
| Example 2 | 35 | 39 | 42 | 44 | 45 | 43 | 42 |
| Comparative Example 3 | 7 | 8 | 12 | 7 | 6 | 6 | 5 |

Figure 2:
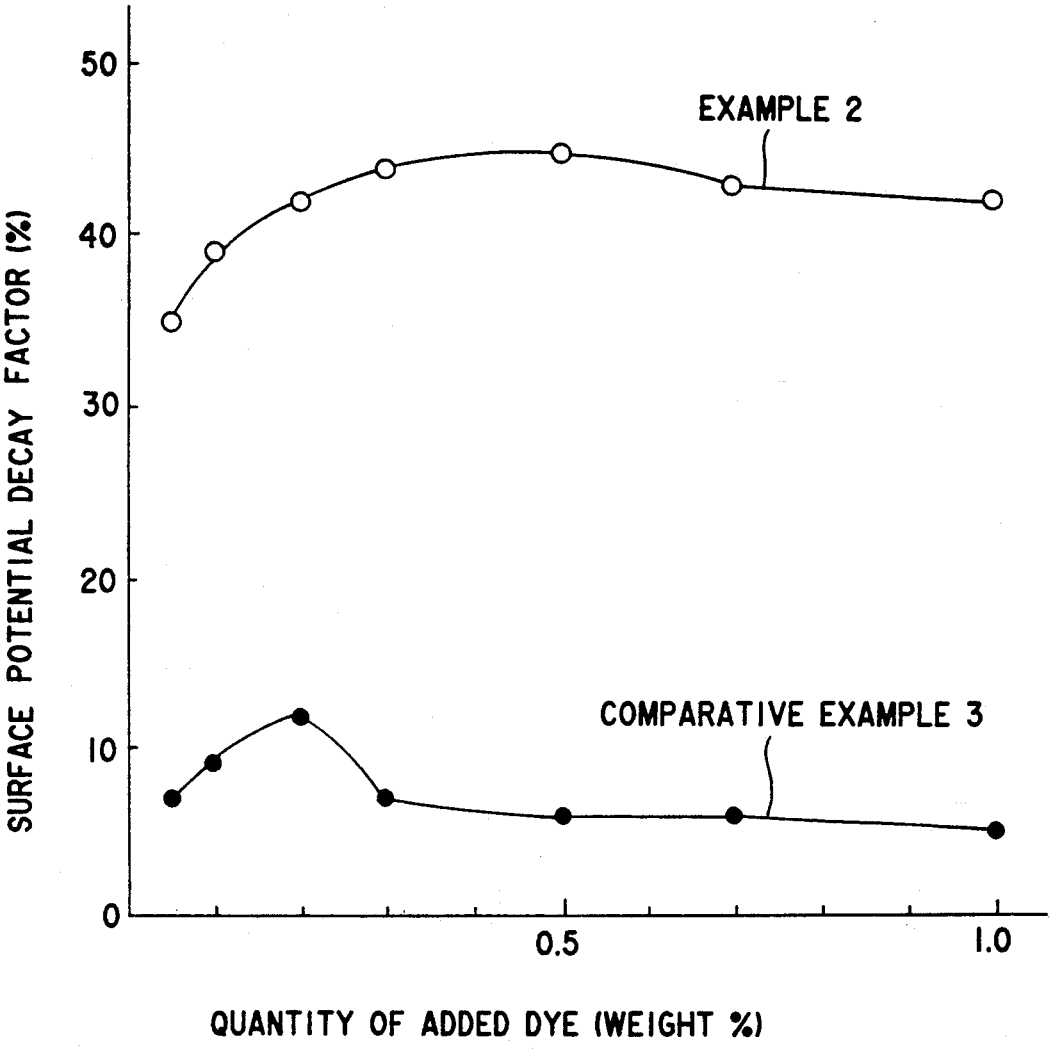
FIG. 2 is a graph showing the relationship between the quantity of added dye and the surface potential decay factor for two varieties of toners.

The results shown in FIG. 2 demonstrate that if the cyanine dye of Example 1 is used, then the surface potential decay factor does not diminish as the quantity of added dye is increased.

COMPARATIVE EXAMPLE 4

A particulate toner D with mean grain size of 10 μm was obtained by the same procedure as in Comparative Example 1, except that the cyanine dye KN-126 (brand name, Nihon Photosensitive Dye Laboratories, Ltd.), with the structure shown in formula [F] below, was used in place of fluorescein, in the proportion of 0.1 weight percent relative to zinc oxide.

The toner D so obtained was consolidated with a presser to produce a pressed toner sample, and a tandem electrode was vapor-deposited onto the pressed toner sample obtained. Then, a 100 V voltage was applied upon the electrode, the sample was irradiated for approximately 0.5 sec. with monochromatic light of wavelength 780 nm extracted by means of a monochromator, and the electrical current before and after exposure to light was measured with an electrometer. The results are shown in Table 3.

[F]

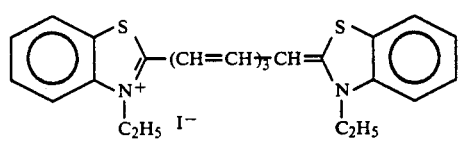

EXAMPLE 3

A particulate toner E with mean grain size of 10 μm was obtained by the same procedure as in Comparative Example 1, except that the aforesaid cyanine dye (C) was used in place of fluorescein in the proportion of 0.1 weight percent relative to zinc oxide.

The electrical current before and after exposure to light was measured with respect to the resulting toner E in the same manner as in Comparative Example 4. The results are shown in Table 3.

COMPARATIVE EXAMPLE 5

A particulate toner F with mean grain size of 10 μm was obtained by the same procedure as in Comparative Example 1, except that the cyanine dye KN-125 (brand name, Nihon Photosensitive Dye Laboratories, Ltd.), with the structure shown in formula [G] below, was used in place of fluorescein in the proportion of 0.1 weight percent relative to zinc oxide.

The electrical current before and after exposure to light was measured with respect to the resulting toner F in the same manner as in Comparative Example 4 above. The results are shown in Table 4.

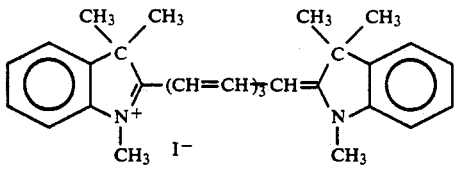

[G]

EXAMPLE 4

A particulate toner G with a mean grain size of 10 μm was obtained by the same procedure as in Comparative Example 1, except that the aforesaid cyanine dye (D) was used in place of fluorescein in the proportion of 0.1 weight percent relative to zinc oxide.

The electrical current before and after exposure to light was measured with respect to the resulting toner G in the same manner as in Comparative Example 4 above. The results are shown in Table 4.

TABLE 3

| | Dye | Id | Il | Gain |
|---|---|---|---|---|
| Comparative Example 4 | Cyanine Dye (F) | 9.65E − 10 | 1.08E − 07 | 1.11E + 02 |
| Example 3 | Cyanine Dye (C) | 2.30E − 09 | 2.05E − 07 | 8.91E + 01 |

TABLE 4

| | Dye | Id | Il | Gain |
|---|---|---|---|---|
| Comparative Example 5 | Cyanine Dye (G) | 2.03E − 10 | 4.18E − 08 | 2.06E + 02 |
| Example 4 | Cyanine Dye (D) | 4.21E − 10 | 1.27E − 07 | 3.04E + 02 |

As is apparent from Table 3, toner E (Example 3) obtained by using the cyanine dye (C) with the structure of the present invention shows a relatively large photoelectric current value Id in the 780 nm wavelength region.

Moreover, from Table 4, toner G (Example 4) obtained by using the cyanine dye (D) with the structure of the present invention shows a relatively large photoelectric current value Id and a relatively large gain Il/Id in the 780 nm wavelength region, demonstrating the improved photosensitivity of this toner, and its utility as photoconductive toner with the photosensitivity in the near infrared region.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A photoconductive toner having a light absorption in the near infrared to infrared region, containing a region binder, zinc oxide and a sensitizer dye for sensitization of the zinc oxide, represented by a member of the group consisting of the following formulas (1-2a) and (1-2b),

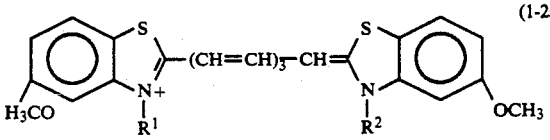

(1-2a)

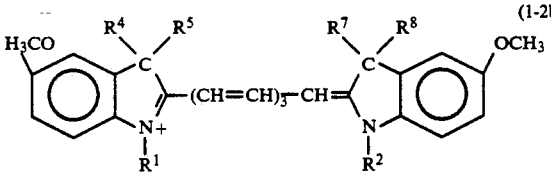

(1-2b)

wherein $R^1$ and $R^2$ are independently alkyl groups having three carbon atoms or less or derivatives thereof, and $R^4$, $R^5$, $R^7$ and $R^8$ are methyl groups, the zinc oxide is contained in the proportion of 3 to 600 weight percent relative to the resin binder, and the sensitizer dye is contained in the proportion of 0.05 to 10 weight percent relative to the zinc oxide.

2. A photoconductive toner according to claim 1, wherein the sensitizer dye for sensitization of the zinc oxide is represented by the following formula (C):

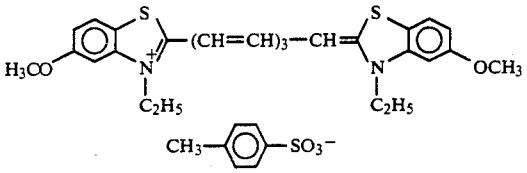

[C]

3. A photoconductive toner according to claim 1, wherein the sensitizer dye for sensitization of the zinc oxide is represented by the following formula (D):

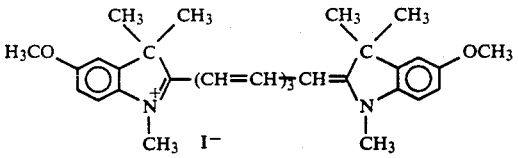

[D]

4. A photoconductive toner according to claim 1, wherein the zinc oxide is contained in the proportion of 5 to 500 weight percent relative to the resin binder.

5. A photoconductive toner according to claim 1, wherein the sensitizer dye is contained in the proportion of 0.1 to 3 weight percent relative to the zinc oxide.

6. A photoconductive toner according to claim 1, wherein the toner has photosensitivity in the wavelength region in the vicinity of 780 nm.

* * * * *